US007448740B2

(12) United States Patent
Asai et al.

(10) Patent No.: US 7,448,740 B2
(45) Date of Patent: Nov. 11, 2008

(54) INKJET CARTRIDGE

(75) Inventors: Naohito Asai, Yokohama (JP); Nobuyuki Matsumoto, Ohta-ku (JP); Hirofumi Okuhara, Ohta-ku (JP); Yasushi Iijima, Arakawa-ku (JP)

(73) Assignee: Canon Kabushiki Kaisha, Tokyo (JP)

( * ) Notice: Subject to any disclaimer, the term of this patent is extended or adjusted under 35 U.S.C. 154(b) by 406 days.

(21) Appl. No.: 11/299,636

(22) Filed: Dec. 12, 2005

(65) Prior Publication Data

US 2006/0132563 A1 Jun. 22, 2006

(30) Foreign Application Priority Data

Dec. 17, 2004 (JP) ..... 2004-366419

(51) Int. Cl.
*B41J 2/175* (2006.01)

(52) U.S. Cl. ..... 347/87

(58) Field of Classification Search ..... 347/85, 347/86, 87

See application file for complete search history.

(56) References Cited

U.S. PATENT DOCUMENTS 4,672,432 A * 6/1987 Sakurada et al. ..... 358/534
4,771,295 A 9/1988 Baker
5,926,195 A 7/1999 Domhoff
6,019,465 A * 2/2000 Shinada et al. ..... 347/93
6,260,961 B1 7/2001 Seu
6,286,932 B1 * 9/2001 Hirano ..... 347/43
6,347,864 B1 * 2/2002 Silverbrook et al. ..... 347/85
6,729,713 B2 * 5/2004 Shirakawa ..... 347/43
6,812,953 B2 * 11/2004 Peterson et al. ..... 347/12

* cited by examiner

*Primary Examiner*—Anh T. N. Vo
(74) *Attorney, Agent, or Firm*—Canon USA Inc I.P. Div

(57) ABSTRACT

An inkjet cartridge having a plurality of ink reservoirs and a plurality of nozzle rows without variations in lengths of ink flow paths communicating the ink reservoirs with the nozzle rows. An inkjet cartridge includes a tank part having a plurality of ink reservoirs and a head part having nozzle rows, each nozzle row having a plurality of nozzles from which ink supplied from the tank part is ejected. Each of ink supply ports provided in each of the ink reservoirs is communicated with a predetermined nozzle row via an ink flow path, and the plurality of ink reservoirs are formed by dividing an internal space of the tank part into equal parts on a plane perpendicular to an ink ejection direction while lengths of a plurality of ink flow paths are the same.

7 Claims, 7 Drawing Sheets

INKJET CARTRIDGE

BACKGROUND OF THE INVENTION

1. Field of the Invention

The present invention relates to an inkjet cartridge for use in an inkjet recording apparatus.

2. Description of the Related Art

In an inkjet recording system, ink droplets are ejected from discharge ports (also referred to as nozzles) provided in a recording head toward a recording medium so as to achieve recording. Ink is stored in an ink tank integrally or separately provided in the recording head. The ink contained in the ink tank is supplied to the recording head via an ink supply opening provided in the ink tank.

Regardless of whether the ink tank is integrated with the recording head or separate therefrom, a plurality of ink reservoirs (also referred to as ink chambers or simply chambers) may be provided within the ink tank. With an increasing number of ink reservoirs, the size of the ink tank or recording head needs to be increased. However, there is a limitation on the size in a space in the recording apparatus where the ink tank or the recording head is mounted. On the other hand, in order to increase the number of ink reservoirs without increasing the size of the ink tank or the recording head, the volume of each of the ink reservoirs has to be reduced. However, the reduction in volume of the ink reservoir may cause more frequent tank replacement.

In U.S. Pat. No. 4,771,295, a multi-chamber inkjet recording head is disclosed, in which ink chambers are arranged in parallel with each other. In U.S. Pat. Nos. 5,926,195 and 6,260,961, a structure is disclosed, in which a first chamber and a plurality of other chambers juxtaposed along the side wall of the first chamber are arranged. In these structures, the first chamber is arranged in the vicinity of the nozzle corresponding thereto, so that ink flow paths from a plurality of the juxtaposed chambers to the first chamber are reduced in length and simplified in structure.

However, in the structure disclosed in U.S. Pat. No. 4,771,295, there have been the following problems. That is, when the ink tank has three or more ink chambers and these ink chambers are linearly arranged, the length of the ink flow path from the remote ink chamber to the nozzle is relatively increased. If the length of the ink flow path is elongated, dust and bubbles are liable to be mixed, elevating the incidence rate of ejection failure or non-ejection. If a plurality of ink chambers with different lengths is mixed, a problem also arises in that the flow path design is complicated. The entire length of such flow paths has to be filled with ink, so that wasteful ink is increased. Since the length and shape of each ink flow path are different, the flow resistance may become nonuniform in the ink flow path. Additionally, entirely juxtaposing a plurality of ink chambers makes the recording head width wide, resulting in less convenience for handling.

On the other hand, in the structures disclosed in U.S. Pat. Nos. 5,926,195 and 6,260,961, there have been the following problems. That is, in comparison with the first chamber, the flow path length to the nozzle of a plurality of the other chambers juxtaposed is also elongated so that the ink flow path length cannot be also uniformed. The arrangement and the flow path design are complicated in the same way as in the structure disclosed in U.S. Pat. No. 4,771,295. Furthermore, when the number of ink flow chambers is four or more, the flow path length between the most remote chamber from the nozzle and the nozzle becomes very long in comparison with that between the first chamber and the nozzle, so that the effect is scarcely expected.

SUMMARY OF THE INVENTION

The present invention is directed to an inkjet cartridge that achieves reduction in size and maximizing volumes of ink reservoirs.

An inkjet cartridge according to one aspect of the present invention includes a tank part having a plurality of ink reservoirs; a head part having a plurality of nozzle rows, each row having a plurality of nozzles from which ink supplied from the tank part is ejected; a plurality of ink supply ports provided in each of the ink reservoirs; and a plurality of ink flow paths facilitating communication between each of the ink supply ports with a predetermined nozzle row of the plurality of nozzle rows, wherein volumes of the plurality of ink reservoirs are substantially the same while lengths of the plurality of ink flow paths are substantially the same.

In an inkjet cartridge according to another aspect of the present invention, lengths of the plurality of ink flow paths are substantially the same, and a center of the head part on a section substantially perpendicular to the ink ejection direction of head part is deflected from the center of the tank part on a section substantially perpendicular to the ink ejection direction of the tank part.

In the inkjet cartridge according to the present invention, the plurality of ink reservoirs are formed by dividing an internal space of the tank part into substantially equal parts on a plane substantially perpendicular to an ink ejection direction. Hence, an inkjet cartridge is achieved without variations in lengths of ink flow paths, in which the distance between the ink reservoir and the nozzle row of one combination is short while the distance between the ink reservoir and the nozzle row of another combination is large.

Further features of the present invention will become apparent from the following description of exemplary embodiments with reference to the attached drawings.

DESCRIPTION OF THE EMBODIMENTS

First Embodiment

Figure 1A:
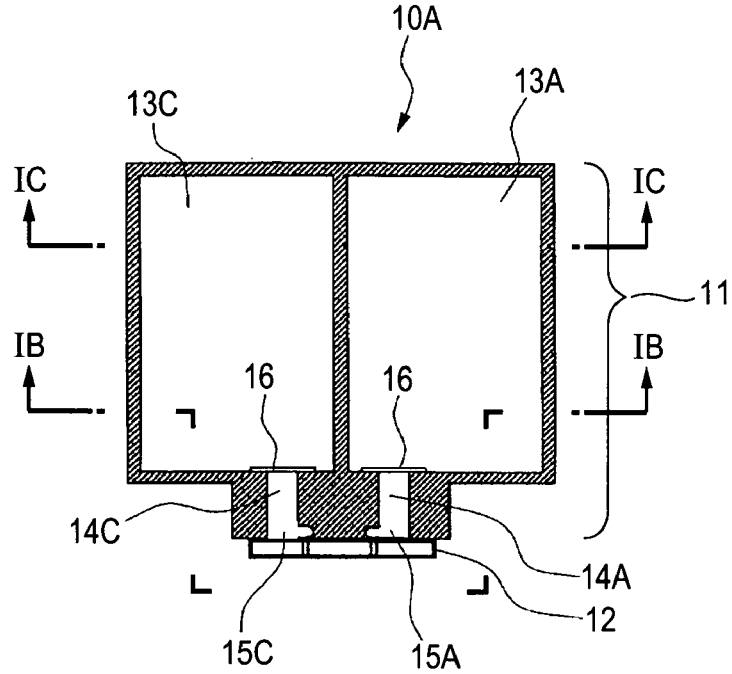
FIG. 1A is a longitudinal sectional view of an ink cartridge according to a first embodiment.
Figure 1B:
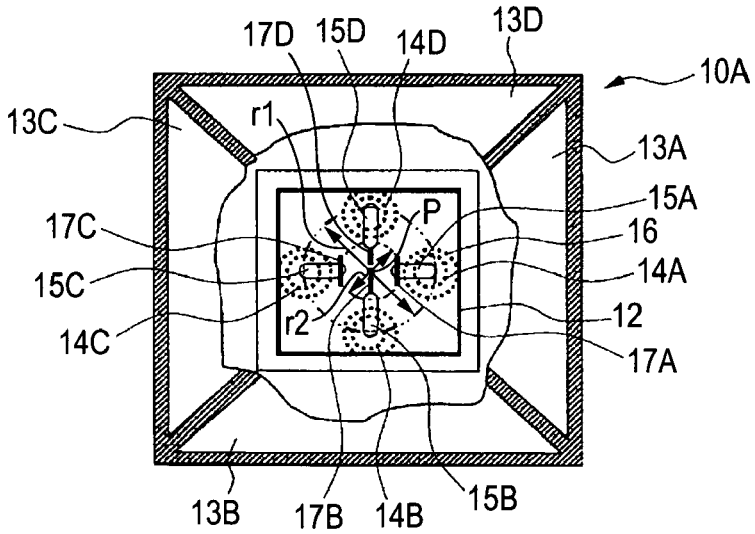
FIG. 1B is a cross-sectional view at the line of A-A' of FIG. 1A.
Figure 1C:
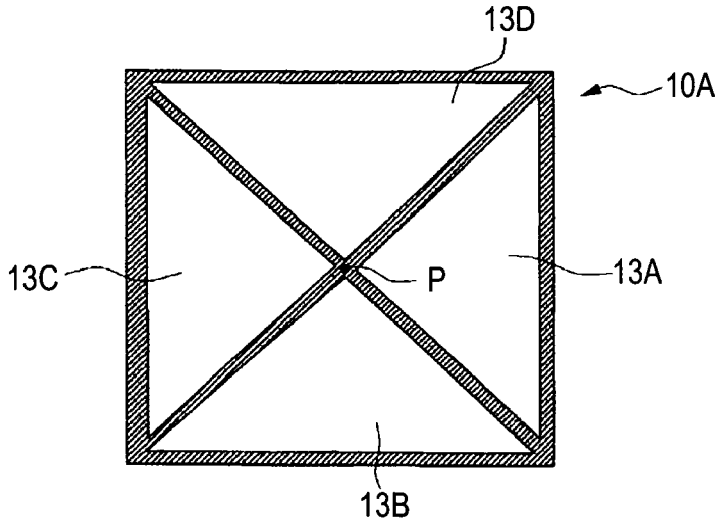
FIG. 1C is a cross-sectional view at the line of B-B' of FIG. 1A.

An ink cartridge according to a first embodiment of the present invention will be described below with reference to FIGS. 1A to 1C. FIG. 1A is a longitudinal sectional view of an ink cartridge 10A according to the first embodiment; FIG. 1B is a cross-sectional view at the line of A-A' of FIG. 1A; and FIG. 1C is a cross-sectional view at the line of B-B' of FIG. 1A.

As shown in FIGS. 1A to 1B, the ink cartridge 10A according to the first embodiment includes a tank part 11 and a head part 12 which are integrally provided. The tank part 11 includes four ink reservoirs 13A to 13D. Specifically, the four ink reservoirs 13A to 13D are formed by dividing the internal space of the tank part 11 into equal quarters on a plane perpendicular to the ink ejection direction about the center. The internal space of the tank part 11 herein is a rectangular parallelepiped with square bottom and top surfaces, and the cross-section of each of the ink reservoirs 13A to 13D, which are formed by dividing the internal space into equal quarters, is a congruent isosceles triangle. Furthermore, the depth of each of the ink reservoirs 13A to 13D is the same. That is, each of the ink reservoirs 13A to 13D has a three-dimensionally congruent shape.

Underneath the ink reservoirs 13A to 13D, ink supply ports 14A to 14D and ink flow paths 15A to 15D are provided, respectively. Ink contained in the ink reservoirs 13A to 13D is fed to the head part 12 via the corresponding ink supply port of the ink supply ports 14A to 14D and the corresponding ink flow path of the ink flow paths 15A to 15D. The four ink supply ports 14A to 14D are arranged on a circumference about the center P of the tank part 11 and with a radius of r1. At each inlet of the ink supply ports 14A to 14D, a filter 16 is arranged for preventing dust from entering the ink flow paths 15A to 15D.

The head part 12 is provided with at least a plurality of nozzles for ejecting the ink fed toward a recording medium (not shown) as mentioned above and an ejection energy generating element (an electrothermal conversion element according to the embodiment) for generating energy of ink ejecting from each nozzle. More specifically, a plurality of the nozzles are grouped corresponding to the ink reservoirs 13A to 13D, and the nozzles belonging to an identical group are arranged in a row so as to form nozzle rows 17A to 17D. According to the embodiment, the four ink reservoirs 13A to 13D and the four nozzle rows 17A to 17D are provided, and ink supplied from the ink reservoirs 13A to 13D is ejected from the nozzles constituting the corresponding nozzle row of the rows 17A to 17D. Furthermore, the four nozzle rows 17A to 17D are arranged on a circumference about the center P of the tank part 11 and with a radius of r2 (r1>r2). That is, the ink supply ports 14A to 14D and the nozzle rows 17A to 17D are arranged on concentric circles, respectively. Each of the ink flow paths 15A to 15D communicating between the ink supply ports 14A to 14D and the corresponding nozzle row of the nozzle rows 17A to 17D has the same very short length.

The ink cartridge 10A constructed as described above can be molded by an arbitrary molding method such as injection molding, compaction molding, transfer molding, and thermoforming. For example, a thermoplastic resin (an engineering plastic) can be injection-molded. The thermoplastic resin suitable for the material is not limited to a specific resin. However, selecting the material requires taking into account demands for the strength against temperature/humidity variation, the joining possibility by any method, such as an adhesive, a thermal bonding, and an oscillation bonding, and chemical and ink resistance in addition to the moldability. The materials satisfying these demands include polyester, polycarbonate, polypropylene, polyethylene, denatured polyphenylene oxide (PPO), and their mixture. The thermoplastic resin may contain a filler. When using the filler, it is not limited to an inorganic filler, but may include glass and graphite (black lead).

The ink reservoirs 13A to 13D, the ink supply ports 14A to 14D, and the ink flow paths 15A to 15D constituting the tank part 11 may be made entirely integral or may be made partially separate and then integrated.

Second Embodiment

Figure 2A:
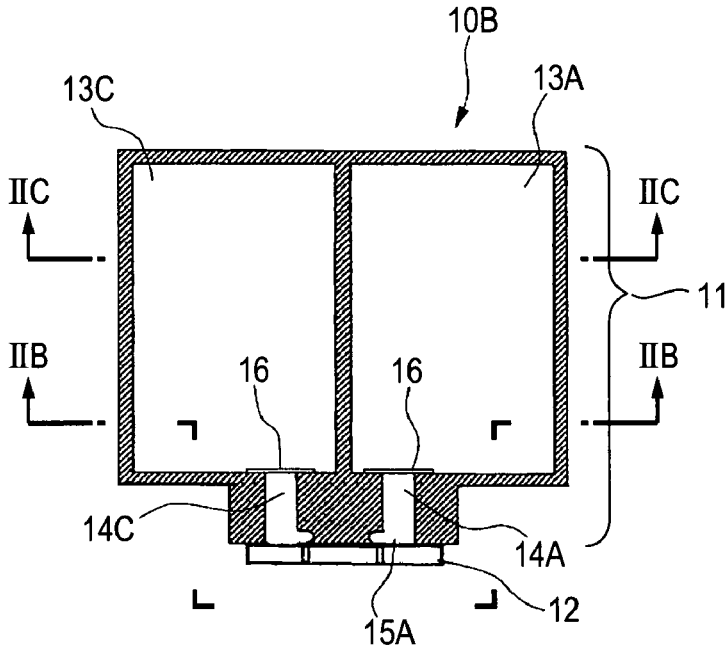
FIG. 2A is a longitudinal sectional view of an ink cartridge according to a second embodiment.
Figure 2B:
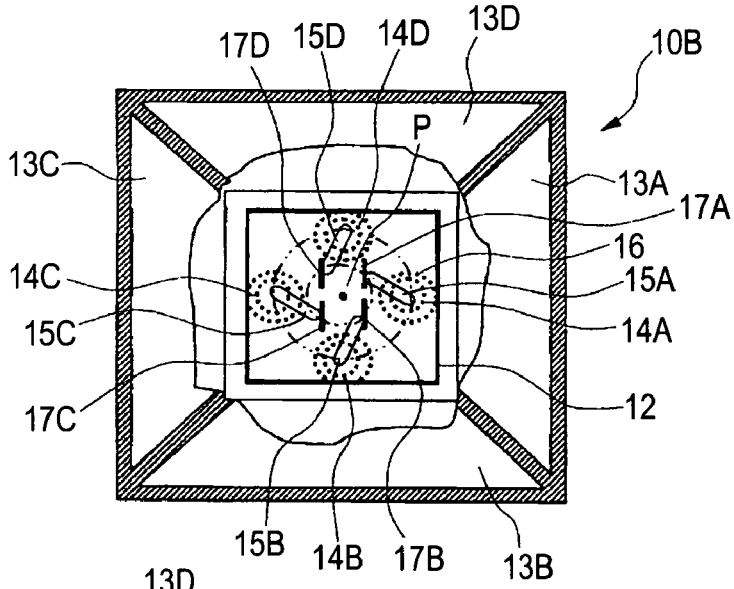
FIG. 2B is a cross-sectional view at the line of A-A' of FIG. 2A.
Figure 2C:
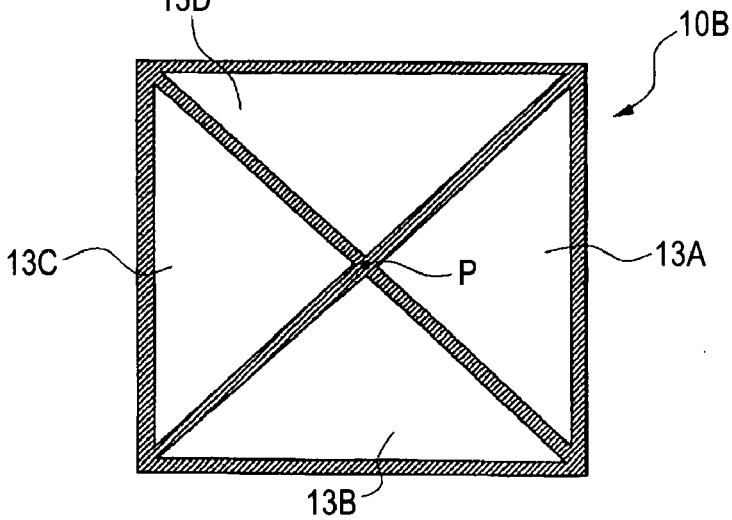
FIG. 2C is a cross-sectional view at the line of B-B' of FIG. 2A.

An inkjet cartridge according to a second embodiment of the present invention will be described with reference to FIGS. 2A to 2C. An inkjet cartridge 10B according to the second embodiment shown in FIGS. 2A to 2C has a fundamental structure common to the inkjet cartridge 10A according to the first embodiment. Thus, like reference characters in FIGS. 2A to 2C designate like elements common to the inkjet cartridge 10A according to the first embodiment, and the description thereof is omitted.

The difference of the inkjet cartridge 10B according to the second embodiment from the inkjet cartridge 10A according to the first embodiment is only the arrangement of the nozzle rows 17A to 17D. That is, in the inkjet cartridge 10A shown in FIGS. 1A to 1C, the two nozzle rows 17B and 17D are arranged on a common straight line parallel to the nozzle rows 17B and 17D. Also, the other two nozzle rows 17A and 17C are arranged on straight lines perpendicular to the nozzle rows 17A and 17C. Whereas, in the inkjet cartridge 10B according to the embodiment, the nozzle rows 17A and 17B are arranged on a common straight line parallel to the nozzle rows 17A and 17B; and the nozzle rows 17C and 17D are arranged on another common straight line parallel to the nozzle rows 17C and 17D. Furthermore, the nozzle rows 17B and 17C and the nozzle rows 17A and 17D are arranged in parallel with each other. However, the lengths of the ink flow paths 15A to 15D communicating the ink supply ports 14A to 14D to the corresponding nozzle row of the rows 17A to 17D are all the same and are short as small as possible.

Third Embodiment

Figure 3A:
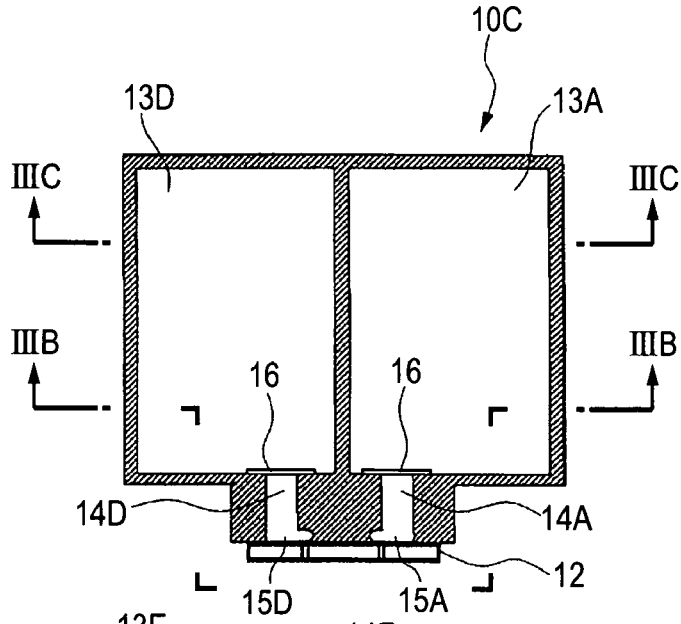
FIG. 3A is a longitudinal sectional view of one ink cartridge according to a third embodiment.
Figure 3B:
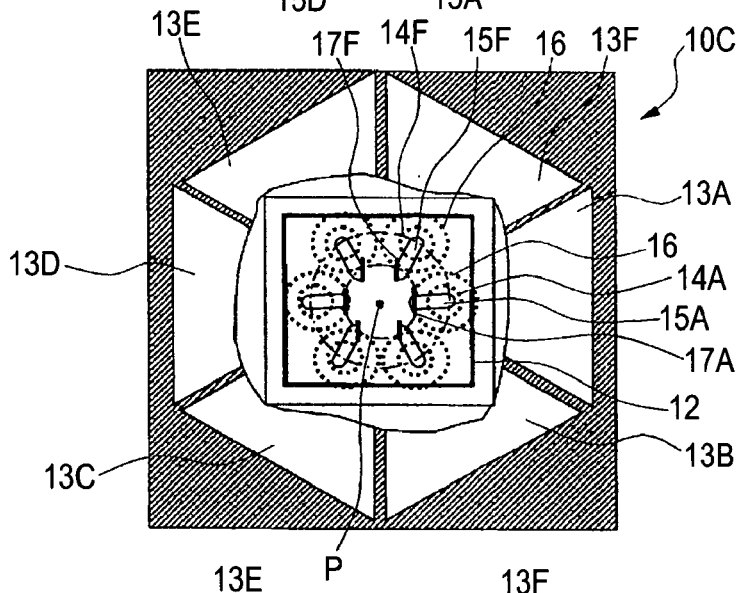
FIG. 3B is a cross-sectional view at the line of A-A' of FIG. 3A.
Figure 3C:
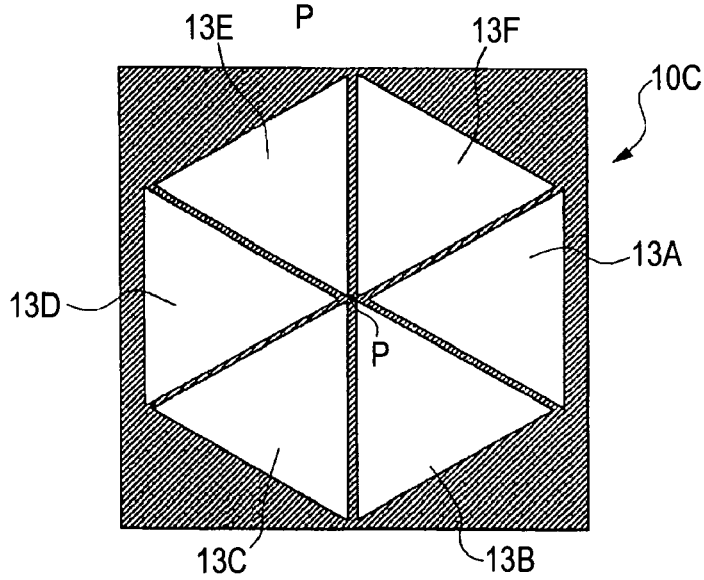
FIG. 3C is a cross-sectional view at the line of B-B' of FIG. 3A.
Figure 4A:
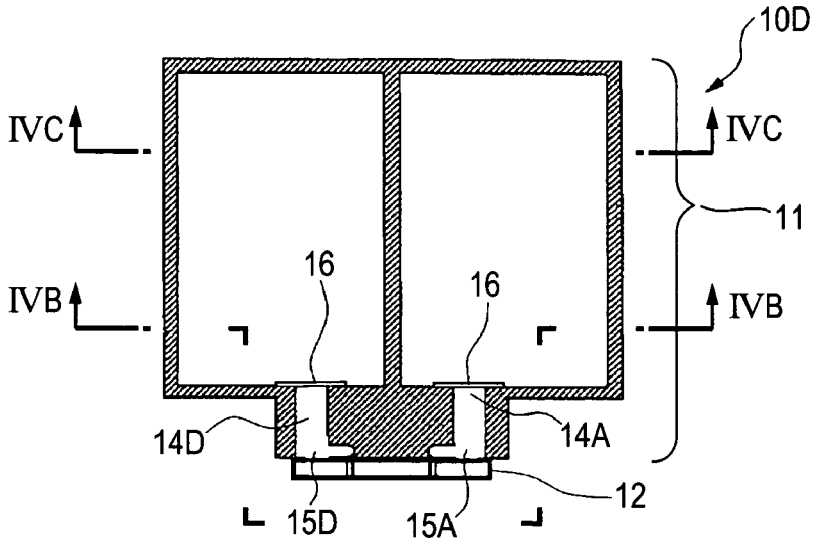
FIG. 4A is a longitudinal sectional view of another ink cartridge according to the third embodiment.
Figure 4B:
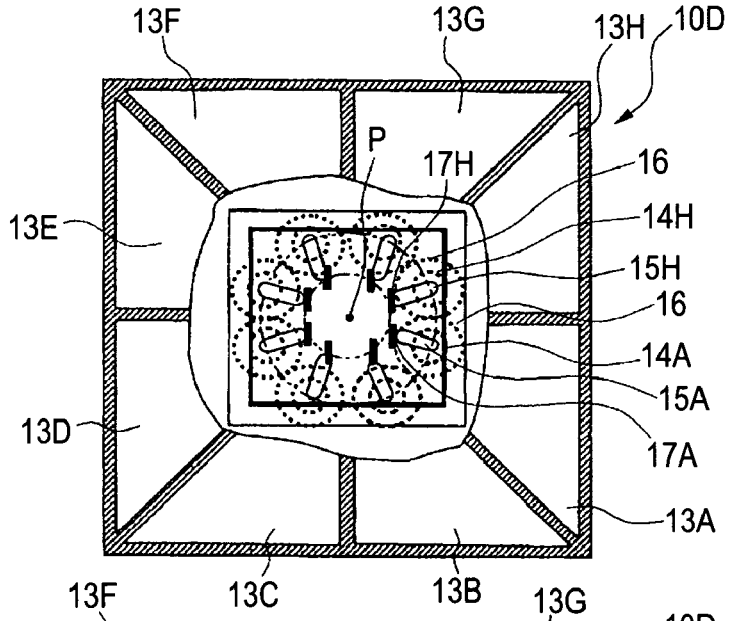
FIG. 4B is a cross-sectional view at the line of A-A' of FIG. 4A.
Figure 4C:
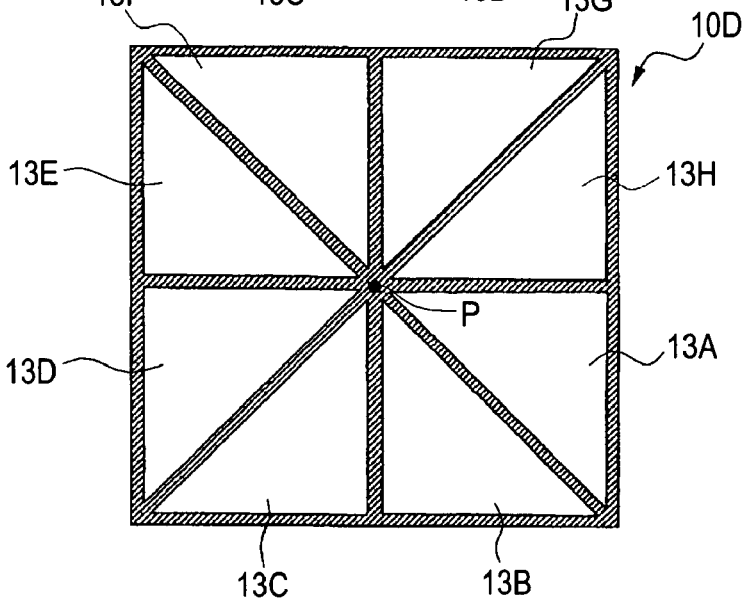
FIG. 4C is a cross-sectional view at the line of B-B' of FIG. 4A.
Figure 5:
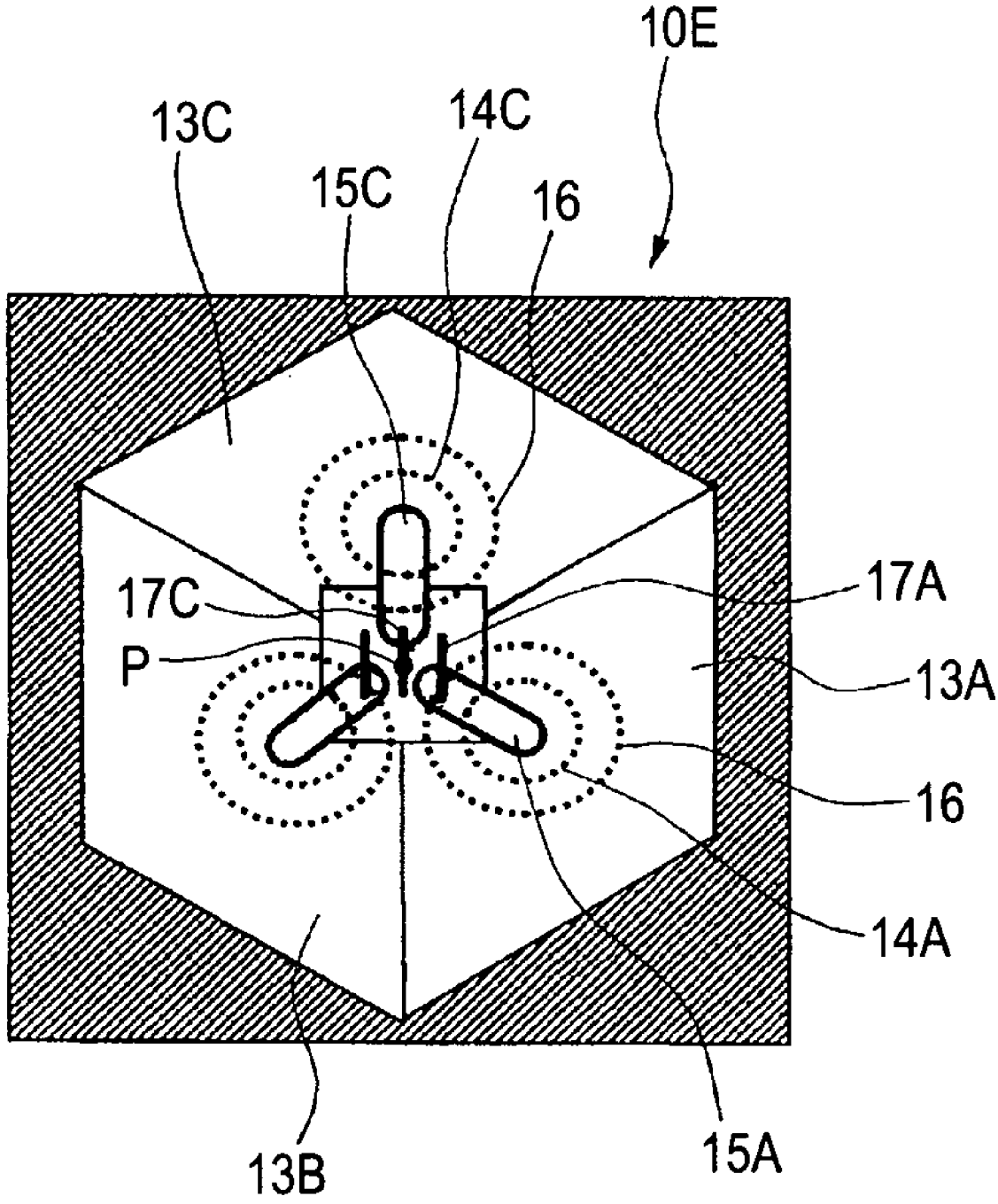
FIG. 5 is a cross-sectional view of another ink cartridge according to the third embodiment.

Inkjet cartridges according to other embodiments of the present invention are shown in FIGS. 3A to 5. FIGS. 3A and 4A are longitudinal sectional views of inkjet cartridges 10C to 10D, respectively; FIGS. 3B and 4B are cross-sectional views at line A-A' of FIGS. 3A and 4A, respectively; and FIGS. 3C and 4C are cross-sectional views at line B-B' of FIGS. 3A and 4A, respectively. FIG. 5 is a drawing of inkjet cartridge 10E.

The inkjet cartridges 10C to 10E respectively shown in FIGS. 3A to 5 have a common feature, and this feature is the same as that of the inkjet cartridge 10A according to the first embodiment. That is, the ink supply ports, the ink flow paths, and the nozzle rows are provided corresponding to each ink reservoir, and the ink supply ports and the nozzle rows are arranged on concentric circles while all the lengths of the ink flow paths are the same.

Then, the difference of the inkjet cartridges 10C to 10E will be described. However, the description of the structures described already is omitted by designating like reference characters in each drawing. The difference of the inkjet cartridges 10C to 10E is the number of the ink reservoirs 13. Specifically, the inkjet cartridge 10C shown in FIGS. 3A to.

3C has six ink reservoirs 13A to 13F. The inkjet cartridge 10D shown in FIGS. 4A to 4C has eight ink reservoirs 13A to 13H. The inkjet cartridge 10E shown in FIG. 5 has three ink reservoirs 13A to 13C. In the ink reservoirs of any inkjet cartridge, the internal space of the tank part 11 is divided into equal parts on a plane perpendicular to the ink ejection direction. Specifically, in the inkjet cartridge 10C, the internal space is divided into six equal parts; in the inkjet cartridge 10D, the space is divided into eight equal parts; and the inkjet cartridge 10E, the space is divided into three equal parts, so that these respective number of ink reservoirs are formed. Thus, each of the ink reservoirs of the inkjet cartridges 10C to 10E has a three-dimensionally congruent shape.

Fourth Embodiment

Figure 6A:
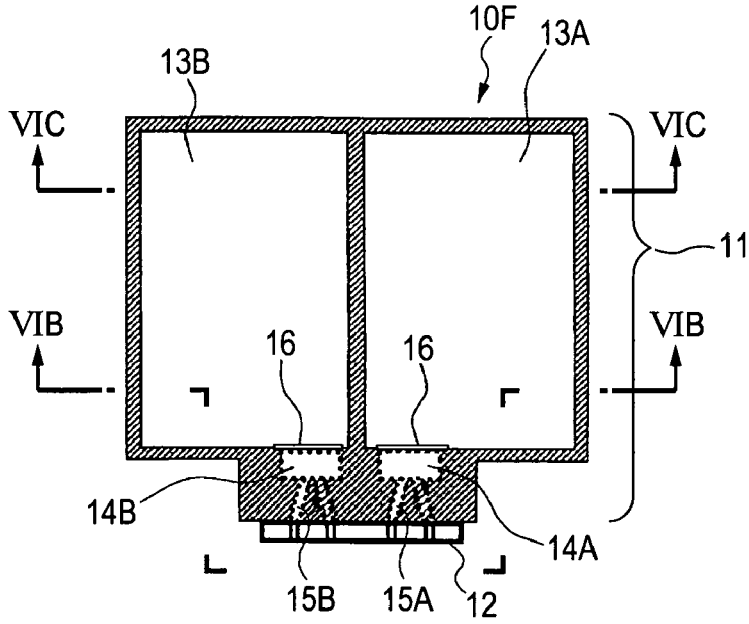
FIG. 6A is a longitudinal sectional view of an ink cartridge according to a fourth embodiment.
Figure 6B:
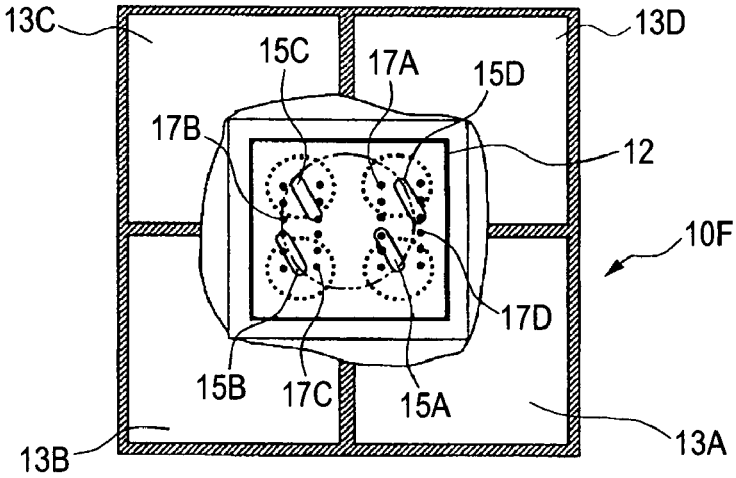
FIG. 6B is a cross-sectional view at the line of A-A' of FIG. 6A.
Figure 6C:
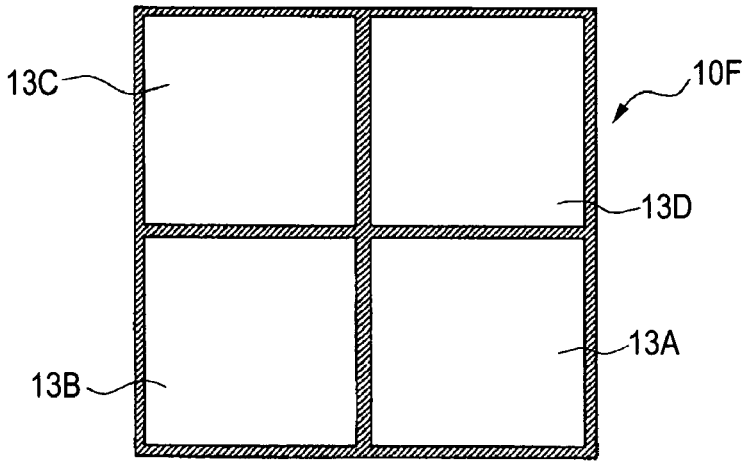
FIG. 6C is a cross-sectional view at the line of B-B' of FIG. 6A.

An inkjet cartridge according to a fourth embodiment of the present invention will be described with reference to FIGS. 6A to 6C. An inkjet cartridge 10F according to the fourth embodiment has a fundamental structure common to the inkjet cartridge 10A according to the first embodiment. Thus, like reference characters in FIGS. 6A to 6C designate like elements common to the inkjet cartridge 10A according to the first embodiment, and the description thereof is omitted.

In the inkjet cartridge 10F, the internal space of the tank part 11 is also divided into equal quarters on a plane perpendicular to the ink ejection direction with partitions parallel to the external walls of the tank part 11 so as to form the four ink reservoirs 13A to 13D. The ink supply ports 14A to 14D and the filters 16 provided at each ink supply port are arranged on concentric circles. However, the nozzle rows 17A to 17D are not arranged on concentric circles. Specifically, the four nozzle rows 17A to 17D are arranged in parallel with each other. However, the lengths of the ink flow paths 15A to 15D communicating the ink supply ports 14A to 14D to the corresponding nozzle row of the rows 17A to 17D are all the same, in the same way as in the ink cartridges according to the other embodiments.

Fifth Embodiment

An inkjet cartridge according to a fifth embodiment of the present invention will be described with reference to FIGS. 7A to 7C. In an inkjet cartridge 10G according to the fifth embodiment, the internal space of the tank part 11 is also divided into equal quarters on a plane perpendicular to the ink ejection direction with partitions parallel to the external walls of the tank part 11 so as to form the four ink reservoirs 13A to 13D, in the same way as in the inkjet cartridge 10F according to the fourth embodiment. However, in the inkjet cartridge 10G according to the embodiment, the head part 12 is located at a position shifted from the center of the tank part 11 by a predetermined distance. Specifically, as show in FIG. 7A, when the inkjet cartridge 10G is mounted on a general printer, the head part 12 is shifted from the center of the tank part 11 and located at a position in a direction from which a recording medium is conveyed. This is taken into consideration of conditions that the head part 12 is to be arranged in a position as close to a paper presser plate 32 as possible, because a recording medium 31 conveyed by a discharge roller 30 becomes free during the moving from the paper presser plate 32 to a discharge part 33.

Figure 7A:
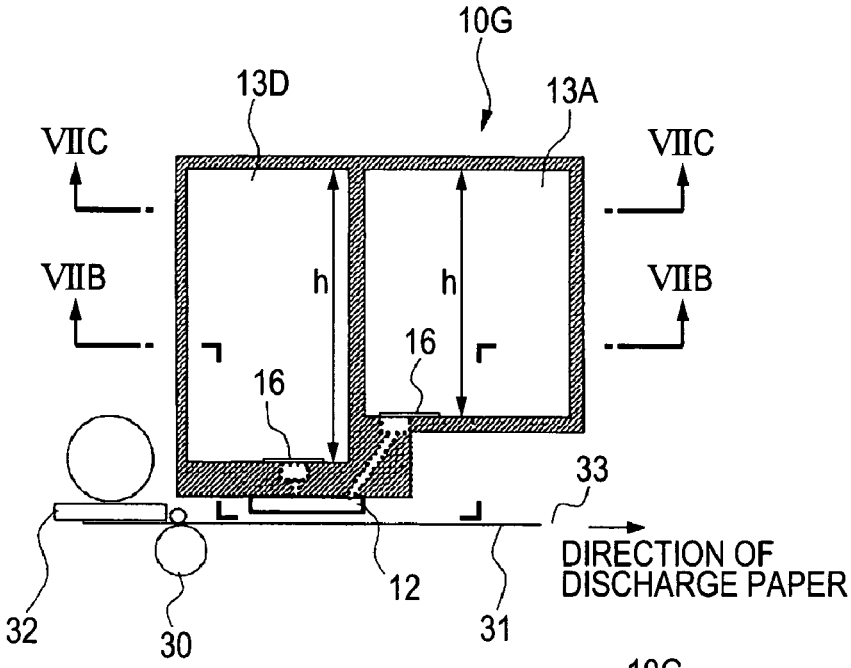
FIG. 7A is a longitudinal sectional view of an ink cartridge according to a fifth embodiment.
Figure 7B:
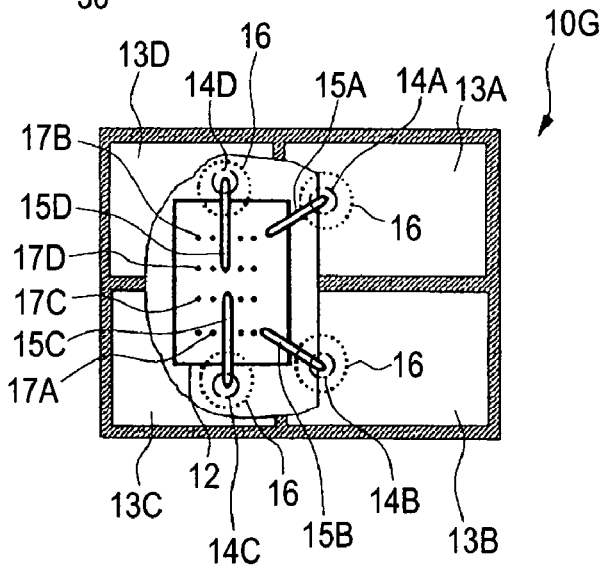
FIG. 7B is a cross-sectional view at the line of A-A' of FIG. 7A.
Figure 7C:
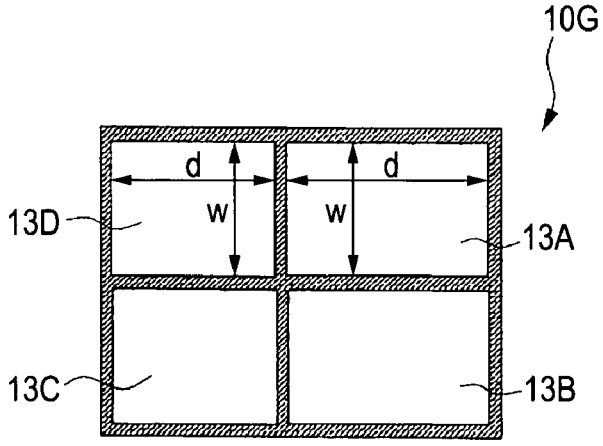
FIG. 7C is a cross-sectional view at the line of B-B' of FIG. 7A.

Different from the inkjet cartridges already described, dimensions in height (h), width (w), and depth (d) of the four ink reservoirs 13A to 13D shown in FIGS. 7A to 7C are not identical. However, the height (h), width (w), and depth (d) of each of the ink reservoirs 13A to 13D are established so as to have the same volume. Specifically, although the width (w) of the ink reservoirs 13A to 13D is common, the height (h) of the ink reservoirs 13A and 13B is lower than that of the ink reservoirs 13C and 13D. Then, the depth (d) of the ink reservoirs 13A and 13B is increased larger than that of the ink reservoirs 13C and 13D so as to have the same volume.

In the inkjet cartridge 10G according to the embodiment, the ink supply ports 14A to 14D provided at each ink supply port are not arranged on concentric circles while the ink supply ports 14A to 14D are arranged in parallel with each other. However, by adjusting the relative positional relationship between the nozzle rows 17A to 17D and the ink supply ports 14A to 14D, and the routing of the ink flow paths 15A to 15D, all the lengths of the ink flow paths 15A to 15D become three-dimensionally the same.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2004-366419 filed Dec. 17, 2004, which is hereby incorporated by reference herein in its entirety.

What is claimed is:

1. An inkjet cartridge comprising:

a tank part including at least three ink reservoirs;

a head part including at least three nozzle rows, each nozzle row including a plurality of nozzles facilitating ejecting ink supplied from the tank part;

a plurality of ink supply ports provided in each of the ink reservoirs; and at least three ink flow paths facilitating communication between each of the ink supply ports and a predetermined nozzle row of a plurality of nozzle rows, wherein the at least three ink reservoirs are formed by dividing an internal space of the tank part into substantially equal parts on a plane substantially perpendicular to an ink ejection direction while lengths of the at least three ink flow paths are substantially the same.

2. The inkjet cartridge according to claim 1, wherein the plurality of ink supply ports and ends of the plurality of ink flow paths adjacent to the nozzle rows are arranged on concentric circles, respectively.

3. An inkjet cartridge comprising:

a tank part adapted to store ink; and a head part configured to eject ink supplied from the tank part, wherein the tank part is divided into four ink reservoirs on a plane substantially perpendicular to an ink ejection direction with two partitions passing through a center line of the tank part, wherein the respective four ink reservoirs have respective ink supply ports facilitating feeding ink to the head part, wherein the head part includes nozzle rows corresponding to the four ink reservoirs, and wherein lengths of four ink flow paths connecting between the respective nozzle rows and the respective ink supply ports are substantially the same, and the nozzle rows are arranged in parallel with each other.

4. An inkjet cartridge comprising:

a tank part adapted to store ink; and a head part facilitating ejecting ink supplied from the tank part, wherein the tank part is divided into four ink reservoirs on a plane substantially perpendicular to an ink ejection direction, wherein the respective four ink reservoirs have respective ink supply ports facilitating feeding ink to the head part, wherein the head part includes nozzle rows corresponding to the four ink reservoirs, and wherein lengths of four ink flow paths connecting between the respective nozzle rows and the respective ink supply ports are substantially the same, and the nozzle rows are deflected from the center of the tank part.

5. The inkjet cartridge according to claim 4, wherein volumes of the four ink reservoirs are substantially the same.

6. The inkjet cartridge according to claim 4, wherein an intersection of partitions dividing the internal space of the tank part to form the four ink reservoirs is deflected from a center of the tank part in a direction adjacent to the nozzle rows.

7. An inkjet cartridge comprising:

a tank part including at least three ink reservoirs;

a head part including at least three nozzle rows, each row including a plurality of nozzles facilitating ejecting ink supplied from the tank part;

a plurality of ink supply ports provided in each of the ink reservoirs; and at least three ink flow paths facilitating communication between each of the ink supply ports with a predetermined nozzle row of a plurality of nozzle rows, wherein lengths of the at least three ink flow paths are substantially the same, and a center of the head part on a section substantially perpendicular to the ink ejection direction of the head part is deflected from the center of the tank part on a section substantially perpendicular to the ink ejection direction of the tank part.

* * * * *